US005503303A

United States Patent [19]

LaWare et al.

[11] Patent Number: 5,503,303

[45] Date of Patent: Apr. 2, 1996

[54] DUAL FUNCTION SELF-PRESSURIZED AEROSOL ACTUATOR OVERCAP

[75] Inventors: Gus LaWare, Bandera; Dieter W. Lubbecke, Center Point, both of Tex.

[73] Assignee: S. C. Johnson & Son, Inc., Racine, Wis.

[21] Appl. No.: 324,075

[22] Filed: Oct. 14, 1994

[51] Int. Cl.[6] ..... B65D 83/14

[52] U.S. Cl. ..... 222/153.12; 222/402.13; 222/402.14

[58] Field of Search ..... 222/153.12, 402.13, 222/402.14, 402.15, 402.21

[56] References Cited

U.S. PATENT DOCUMENTS

| | | | |
|---|---|---|---|
| 2,761,594 | 9/1956 | Stroh | 222/394 |
| 3,081,918 | 3/1963 | Scoggin, Jr. et al. | 222/394 |
| 3,137,414 | 6/1964 | Steinkamp | 222/182 |
| 3,138,295 | 6/1964 | O'Donnell | 222/182 |
| 3,178,077 | 4/1965 | Benedetto | 222/394 |
| 3,185,350 | 5/1965 | Abplanalp et al. | 222/182 |
| 3,269,614 | 8/1966 | Abplanalp | 222/394 |
| 3,305,144 | 2/1967 | Beres et al. | 222/402.13 |
| 3,373,908 | 3/1968 | Crowell | 222/402.13 |
| 3,424,354 | 1/1969 | Dykinga | 222/402.14 |
| 3,429,483 | 2/1969 | Micallef | 222/153 |
| 3,519,173 | 7/1970 | Sagarin | 222/402.13 |
| 3,642,179 | 2/1972 | Micallef | 222/402.12 |
| 3,765,573 | 10/1973 | Landsman | 222/182 |
| 3,786,968 | 1/1974 | Ewald | 222/402.11 |
| 3,804,302 | 4/1974 | Yamada et al. | 222/182 |
| 3,885,717 | 5/1975 | Ewald | 222/402.11 |
| 3,887,115 | 6/1975 | Petterson | 222/402.13 |
| 3,894,665 | 7/1975 | Swenson | 222/402.11 |
| 3,901,412 | 8/1975 | Copia | 222/182 |
| 3,924,782 | 12/1975 | Starrett | 222/402.11 |
| 4,068,782 | 1/1978 | Van der Heijden | 222/402.13 |
| 4,171,758 | 10/1979 | Corba | 222/402.11 |
| 4,186,853 | 2/1980 | White | 222/182 |
| 4,195,756 | 4/1980 | Campbell | 222/182 |
| 4,260,080 | 4/1981 | Gailitis | 222/402.14 |
| 4,277,004 | 7/1981 | Barlics | 222/402.14 |
| 4,378,081 | 3/1983 | Van Lit | 222/402.13 |
| 4,381,065 | 4/1983 | Hayes | 222/153 |
| 4,428,509 | 1/1984 | Emerson et al. | 222/153 |
| 4,440,325 | 4/1984 | Treuhaft et al. | 222/402.14 |
| 4,697,713 | 7/1987 | Crapser et al. | 222/402.13 |
| 4,805,839 | 2/1989 | Malek | 239/337 |
| 4,941,600 | 7/1990 | Berriochoa et al. | 222/402.13 |
| 5,242,087 | 9/1993 | Keldenich et al. | 222/153 |

FOREIGN PATENT DOCUMENTS

| | | | |
|---|---|---|---|
| 2692559 | 12/1993 | France | 222/153.12 |
| 2312939 | 10/1973 | Germany | 222/153.12 |
| 2136056 | 9/1984 | United Kingdom | 222/153.12 |

*Primary Examiner*—Andres Kashnikow
*Assistant Examiner*—Philippe Derakshani
*Attorney, Agent, or Firm*—R. E. Rakoczy; J. W. Frank

[57] ABSTRACT

An overcap for a self-pressurized aerosol container is disclosed that dispenses the contents of the container as an aerosol spray in either an intermittent or continuous manner. The overcap is particularly useful in conjunction with the delivery of a fine particle size insecticide spray or fog and is economical to manufacture because it has few moving parts. The overcap comprises a shell containing an aerosol actuator button that further contains a mutually cooperable, releasably locking engagement. Intermittent aerosol dispensing is achieved without interference by the engagement. Continuous aerosol dispensing is achieved by having the user position a movable engagement so that it engages the other engagement while the actuator button is held by the user in its dispensing position. The user then releases the actuator button and the engagement retains the actuator button in the atomization position for continuous spraying. The second engagement may be released to stop the continuous spray simply by again pressing the actuator button.

20 Claims, 5 Drawing Sheets

DUAL FUNCTION SELF-PRESSURIZED AEROSOL ACTUATOR OVERCAP

TECHNICAL FIELD

This invention relates to an aerosol actuator overcap for a self-pressurized aerosol container that dispenses the contents of the container as an aerosol spray in either an intermittent or a continuous manner.

BACKGROUND ART

Self-pressurized aerosol containers which dispense a liquid product such as an insecticide, room air freshener or deodorizer as an aerosol spray are well known and widely used because of their convenience. These containers are fitted with a valve which retains the contents of the container under pressure until the contents are needed. The contents of the container may be pressurized by different methods which include a pressurized gas or gases such as liquefied hydrocarbons such as propane, isopropane and isobutane, compressed gases such as nitrogen, air or carbon dioxide, and mechanical means such as expanding bags which force the contents out of the can when the valve is opened. The valve typically has a valve stem which extends to the outside of the container and has a hollow interior through which the contents of the container passes when the valve stem is moved to an open position.

To provide the desired degree of atomization to form an aerosol spray, an aerosol actuator button is tightly fitted over the valve stem. The actuator button contains a passageway ending in an orifice which is adapted to break the liquid stream coming from the interior of the container into aerosol droplets of the desired particle size. The user actuates the aerosol spray by pressing the button down or sideways to open the valve and allow the contents of the container to flow through the actuator button and out the orifice. The aerosol spray stops when the finger pressure on the button is removed. It is often convenient to make the actuator button a part of a larger overcap which is fixed onto the top of the self-pressurized container to provide an attractive and easy to use aerosol dispenser package. Examples of such aerosol actuator buttons, containers and overcaps for the same can be seen from an examination of U.S. Pat. No. 2,761,594 to Stroh; U.S. Pat. No. 3,138,295 to O'Donnell; U.S. Pat. No. 3,269,614 to Abplanalp; U.S. Pat. No. 3,373,908 to Crowell; U.S. Pat. No. 3,429,483 to Micallef; U.S. Pat. No. 3,642,179 to Micallef; U.S. Pat. No. 3,887,115 to Petterson; U.S. Pat. No. 4,068,782 to Van der Heijden; U.S. Pat. No. 4,378,081 to van Lit; and U.S. Pat. No. 4,805,839 to Malek.

U.S. Pat. No. 5,242,087 to Keldenich et al. teaches an aerosol overcap which has a locking lip that prevents spraying until an operating arm in the overcap is moved by exerting a force on a certain part of the overcap.

In many cases, an intermittent aerosol spray is all that is necessary. In other cases a continuous aerosol spray is desired. For example, insecticide fogging applications require that the entire contents of a self-pressurized container of insecticide be delivered as a fine aerosol spray or "fog" throughout an entire room.

One example of a continuous actuator can be seen from U.S. Pat. No. 4,428,509 to Emerson et al. where a safety tab is removed by the user and then the actuator button is pressed down to start the aerosol spray. The button is held down by a locking spur so that the entire contents of the self-pressurized container is dispensed. There is no provision for shutting off the aerosol spray once the actuator button has been pressed.

U.S. Pat. No. 4,941,600 to Berriochoa et al. teaches the use of a ring lock to hold the actuator button in the open position when it is depressed.

U.S. Pat. No. 4,440,325 to Treuhaft et al. teach an actuator button which is held in either the open or the closed position and is said to be easily movable between the two positions.

Other continuous spray actuators which require the user to remove the overcap or reposition some components thereof to achieve continuous spray are described in U.S. Pat. No. 3,137,414 to Steinkamp; U.S. Pat. No. 3,424,354 to Dykinga; U.S. Pat. No. 3,765,573 to Landsman; U.S. Pat. No. 4,186,853 to White; and U.S. Pat. No. 4,195,756 to Campbell.

U.S. Pat. No. 3,305,144 to Beres et al. teaches an aerosol dispenser that has a removable valved conduit for spraying. The valve on the self-pressurized container is held in its open position by an adapter that fits over the valve stem of the container.

U.S. Pat. No. 4,381,065 to Hayes teaches a one piece molded overcap with a discharge actuator that is tabbed to the overcap shell. The tabs are broken and the discharge actuator is folded over to where it is held by detents to provide a continuous aerosol spray. The discharge actuator is lifted to stop the continuous spray.

For certain products such as insecticides, it may also be desirable to provide an overcap which is capable of dispensing the contents of the self-pressurized container either intermittently or continuously as the user desires. Various approaches have been taken to provide such overcaps.

U.S. Pat. No. 4,679,713 to Crapser et al. teaches an aerosol actuator overcap which permits both intermittent and continuous spraying. Intermittent spraying is accomplished by simply pressing on the actuator button. Continuous spraying is accomplished by twisting the outer portion of the overcap so that the actuator button is cammed into a continuous spraying position. One disadvantage of this overcap is that it has several parts which must be fitted together during manufacture. That increases the cost of the overcap as well as the time needed to manufacture the aerosol container.

U.S. Pat. No. 3,185,350 to Abplanalp et al. teaches a an overcap which locks the actuator button from dispensing the contents of the container when the overcap is rotated to one position. Rotation to different positions permits either continuous spray or intermittent spray.

U.S. Pat. No. 3,519,173 to Sagarin teaches a dual function aerosol actuator overcap. When the actuator button is pressed downward, an intermittent spray is obtained which stops when the pressure on the actuator button is released. However, the actuator button may also be tilted or rocked at the same time it is depressed to cause cooperable shoulder portions to become engaged by an interference action and thus prevent return of the actuator button to its normal non-spraying position. The contents of the container are then continuously dispensed until the user again depresses the actuator button and, at the same time, rocks or tilts the button to disengage the cooperable shoulder portions. The actuator button can then return to its normal non-spraying position and the aerosol spray is stopped. However, operation of this aerosol actuator overcap does require some dexterity in pushing down as well as rocking or tilting the actuator button to engage and disengage continuous spraying.

U.S. Pat. No. 3,081,918 to Scoggin, Jr. et al. and U.S. Pat. No. 3,901,412 to Copia use similar actuator buttons to provide intermittent and continuous aerosol dispensing. They employ an actuator button that has a hook that snaps over the edge of the valve when a continuous aerosol spray is desired. To stop the spray, the hook is released by pressing against one side of the actuator button.

U.S. Pat. No. 3,178,077 to Benedetto teaches an actuator button which can be intermittently sprayed by pressing a trigger partly down. Fully depressing the trigger causes engagement with a snap extension which holds the actuator button in its open position. The user presses against the snap extension to release the trigger and stop the spray.

U.S. Pat. No. 3,894,665 to Swenson teaches a safety overcap for an aerosol container which also contains a locking device that permits continuous spraying. However, the sides of the overcap must be squeezed to release the actuator button from its continuous spray position.

U.S. Pat. No. 4,260,080 to Gailitis teaches a mushroom-shaped overcap that can be set to continuous spray when one end of the overcap is pushed down so that it engages the edge of the container. Pressure on the opposite side of the overcap releases the edge engagement to stop the continuous aerosol spray. Gailitis teaches that his overcap has the advantage that the user only needs one hand to discontinue the aerosol spray.

Although aerosol actuator overcaps are described in the prior art, there is still a need for a simple to make and use dual function aerosol actuator overcap.

SUMMARY DISCLOSURE OF THE INVENTION

One object of the present invention is to provide an aerosol actuator overcap for use on self-pressurized liquid containers that is capable of both intermittent and continuous dispensing of the contents of the container. Another object is to provide such dual functions in a manner that is simple and easy to operate. Yet another object of the present invention is to provide an aerosol actuator overcap that possesses such dual functionality, yet has a minimal number of parts. Still another object of this invention is to provide a dual function aerosol actuator overcap that can be manufactured by molding the overcap in a single operation as a single piece. Another object of the present invention is to provide an overcap which only requires one hand to stop the continuous spray.

In a preferred embodiment of the present invention, the object of this invention is to provide a simple means for the continuous mode of aerosol spraying that only requires the user to set a holding means for continuous operation that is automatically disengaged when the user again presses on the actuator button using one hand.

These and other objects of the present invention are provided by an aerosol actuator overcap for a self-pressurized container of a liquid to be atomized where the overcap comprises a shell to which an actuator button is movably affixed. The actuator button contains one engagement means such as a hook, notch, indentation or projection and the shell contains a second engagement means such as a lever or pin flexibly attached to the shell or vice versa. The engagement means are positioned on the shell in such a manner that the second engagement means does not contact the first engagement means in its normal position of rest. The second engagement means is capable of cooperating with and engaging the first engagement means to releasably hold the actuator button in its atomizing position.

In its normal configuration, the user can simply press on the actuator button to provide the desired amount of atomized liquid. The atomized liquid flow is stopped at will when the user releases the actuator button so that it returns to its normal, non-atomizing position.

To achieve a continuous atomizing spray, the user holds the actuator button in its atomizing position and moves the second engagement means over to cooperatively engage or mate with the first engagement means. The actuator button is then held in its atomizing position until the user once again presses on the actuator button to disengage the second engagement means from the first engagement means. The second engagement means returns to its normal position of rest away from engagement with the first engagement means. The actuator button is then released and returns to its normal non-atomizing position. The contents of the container can then be sprayed intermittently by the user until a continuous atomized spray is once again desired.

BRIEF DESCRIPTION OF THE DRAWINGS

The above and other objects, features and advantages of the present invention will become apparent to those skilled in the art upon an examination of this specification and the accompanying drawings.

In the drawings.

BEST MODE OF CARRYING OUT THE INVENTION

Figure 1:
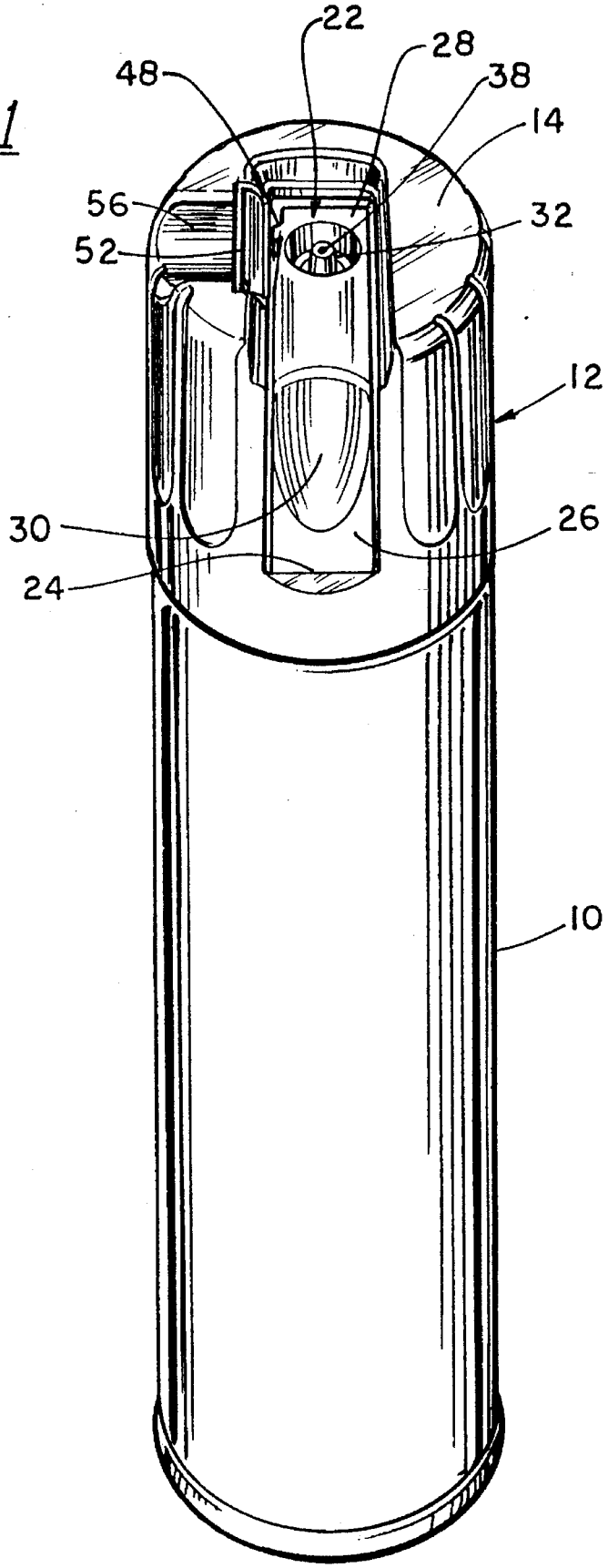
FIG. 1 is a perspective view of an aerosol actuator overcap of the present invention taken from the top rear showing the self-pressurized aerosol container on which it is mounted.
Figure 3:
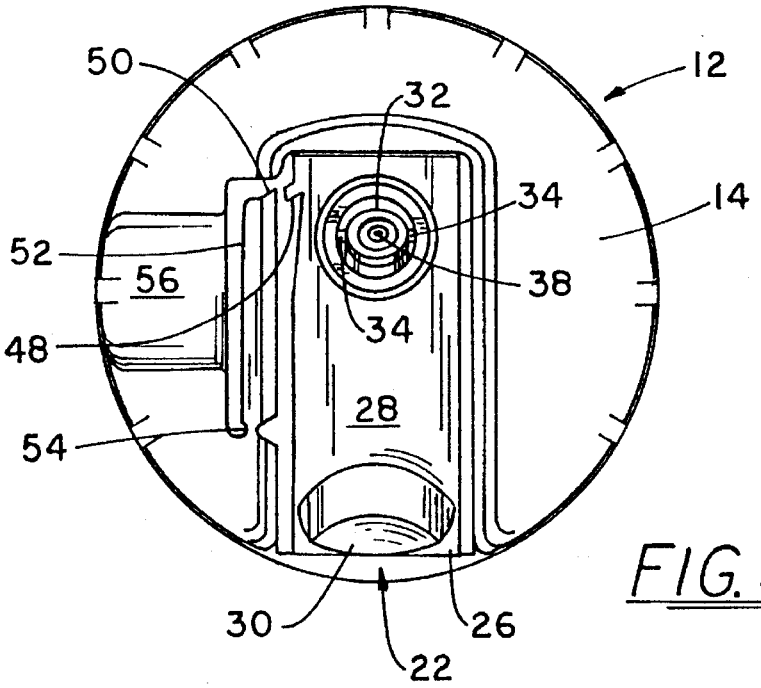
FIG. 3 is a plan view of FIG. 1 showing the actuator button pressed to its intermittent spraying position.

In the drawings, like features are referred to by like reference numerals. Referring to the drawings, FIG. 1 is a perspective view of a self-pressurized container 10 filled with a pressurized liquid to be dispensed (not shown) onto which an aerosol actuator overcap 12 of the present invention is affixed. As better shown in FIG. 5, overcap 12 is composed of a shell 14 which is affixed to rim 16 of container 10 by friction fit between stiffening ribs 18 and locking lips 20. Aerosol actuator button 22 is movably affixed to shell 14 at hinge point 24. Vertical portion 26 of actuator button 22 extends vertically from hinge 24 to horizontal portion 28 and contains finger (or thumb) pad 30. Horizontal portion 28 contains hinge 29 as well as the operative portion of actuator button 22 in the form of a hollow body 32 which is movably affixed to horizontal portion 28 by way of two flexible links 34 as shown in FIG. 3. Alternatively, one or more flexible links could be used to affix hollow body 32 to horizontal portion 28. Hollow body 32 has bore 36 in flow communication with atomizing orifice 38 which is located in the top portion of hollow body 32 and thus in the top portion of actuator button 22 in a position where it faces away from container 10 to allow the spray to be directed where it is desired by the user. Hollow body 32 has a cavity 40 located opposite orifice 38 in the bottom portion of hollow body 32 in actuator button 22.

Cavity 40 sealingly fits over the free end 42 of valve stem 44 extending out of valve 46. Valve stem 44 has a hollow bore (not shown) which permits the pressurized liquid contents of container 10 to pass from the interior of container 10 into bore 36 and out orifice 38 to permit atomization of the liquid contents and thus provide an atomized spray when valve stem 44 is moved to its atomizing position as shown in FIG. 6.

Figure 2:
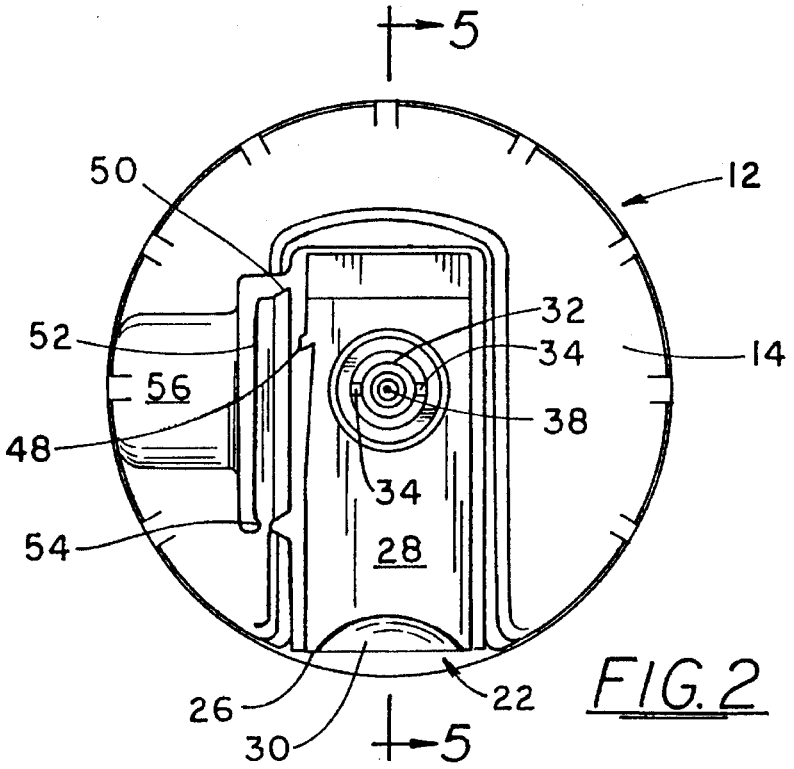
FIG. 2 is a plan view of FIG. 1.
Figure 5:
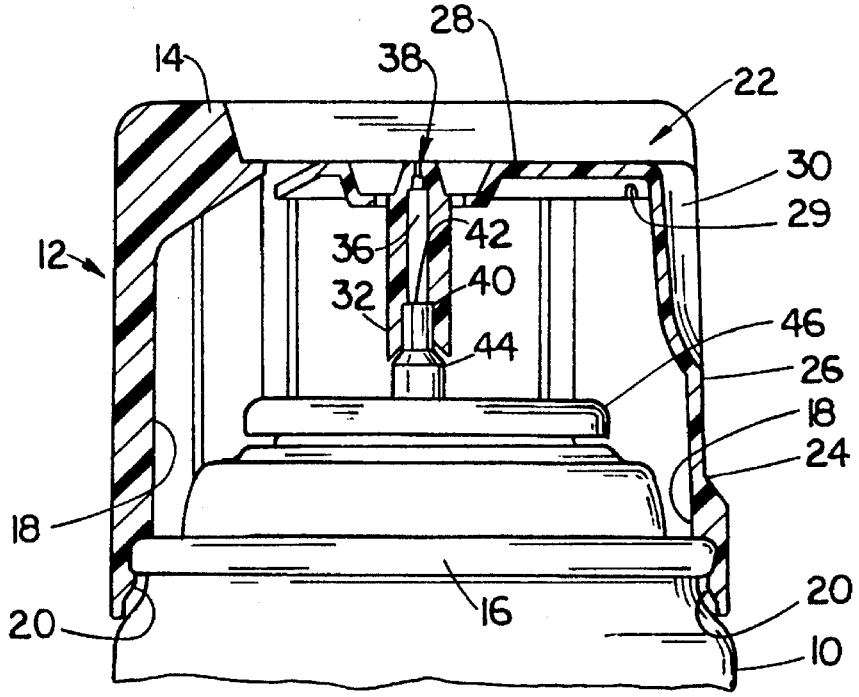
FIG. 5 is a partial cross-sectional view of FIG. 2 taken along section lines 5—5 showing the sealing engagement of the actuator button with the valve stem.
Figure 8:
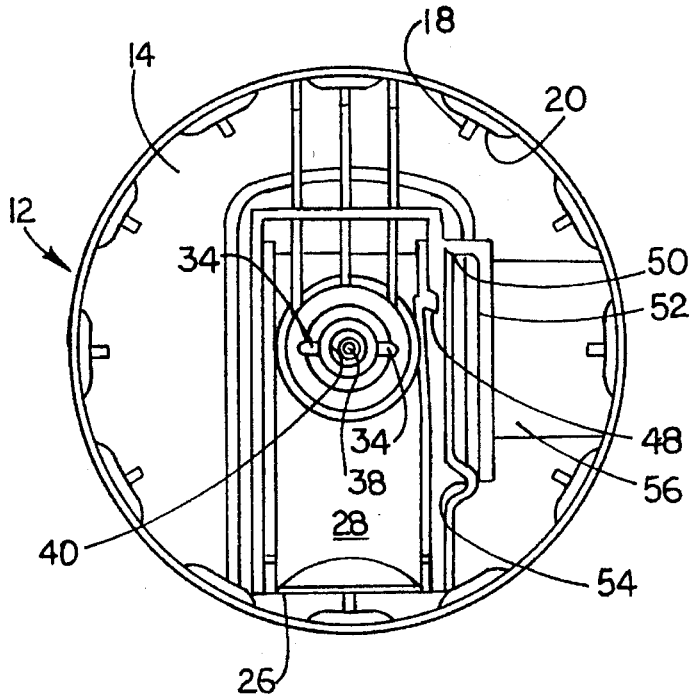
FIG. 8 is a bottom plan view of the interior of the aerosol actuator overcap of FIG. 1.

Normally, valve stem 44 is held by a spring or other conventional means (not shown) inside valve 46 in its non-atomizing position. FIGS. 2, 5 and 8 show actuator button 22 in its normal non-atomizing position where vertical portion 26 is vertical and no pressure is placed on valve stem 44.

Figure 6:
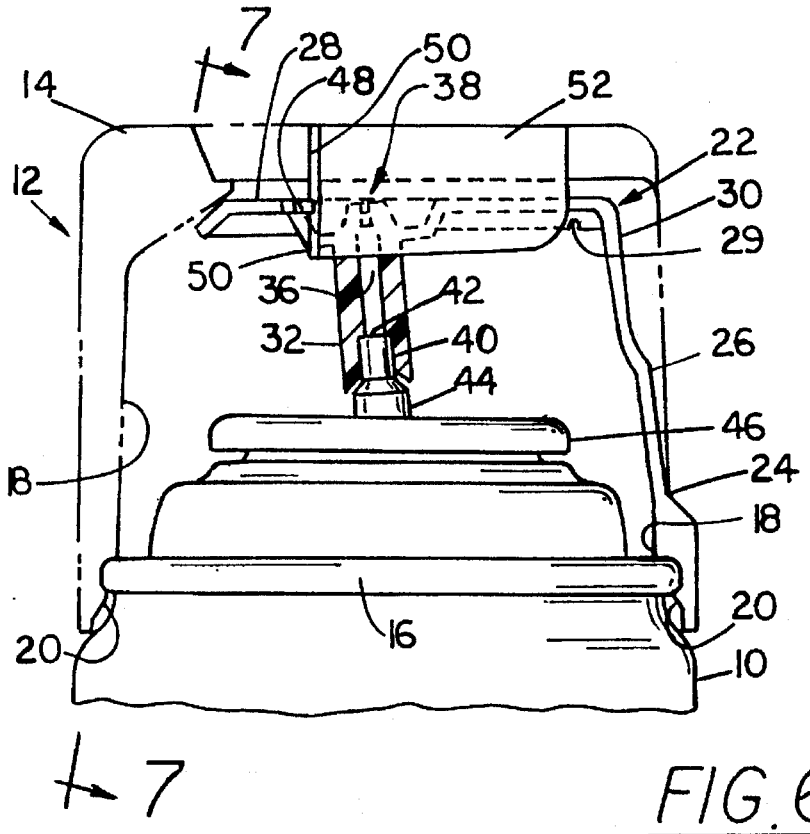
FIG. 6 is a partial cross-sectional view of FIG. 4 taken along section lines 6—6 showing the manner in which the actuator button is retained in its continuous spraying position.

In the preferred embodiment shown in the drawings, particularly in FIGS. 3 and 5–6, valve 46 uses a valve stem 44 that is placed in its atomizing position by a combination of tilting to at least approximately 15° from the vertical coupled with a downward movement of at least about 0.010 inches (0.25 millimeters). An example of such a valve is Seaquist #ST-76-2 available from Seaquist Valve of Cary, Ill. This type of valve accommodates the preferred embodiment of actuator button 22 shown in the drawings.

Thus, when the user places a finger or thumb on finger pad 30 and pushes finger pad 30 toward the center of the container 10, actuator button 22 pivots about hinge point 24, vertical portion 26 moves toward the center of container 10, horizontal portion 28 flexes about hinge 29 so that horizontal portion 28 moves slightly from the horizontal as vertical portion 26 moves from the vertical, and hollow body 32 both tilts and presses downward on valve stem 44. Flexible links 34 permit hollow body 32 to tilt slightly more than the angle defined by vertical portion 26, and the movement of hollow body 32 places valve stem 44 in its atomizing position. The atomizing position is illustrated in FIGS. 3 and 6. When the user releases pressure on the finger pad, actuator button 22 again pivots about hinge point 24 as valve stem 44 returns to its normal non-atomizing position. Thus, overcap 12 provides the user with the ability to spray the contents of container 10 intermittently simply by pressing on finger pad 30 and releasing it.

Those skilled in the art will appreciate that hollow body 32 may also be integrally molded as a part of actuator button 22 as long as actuator button 22 is configured to move in a manner that permits valve stem 44 to be moved to its atomizing position.

Figure 4:
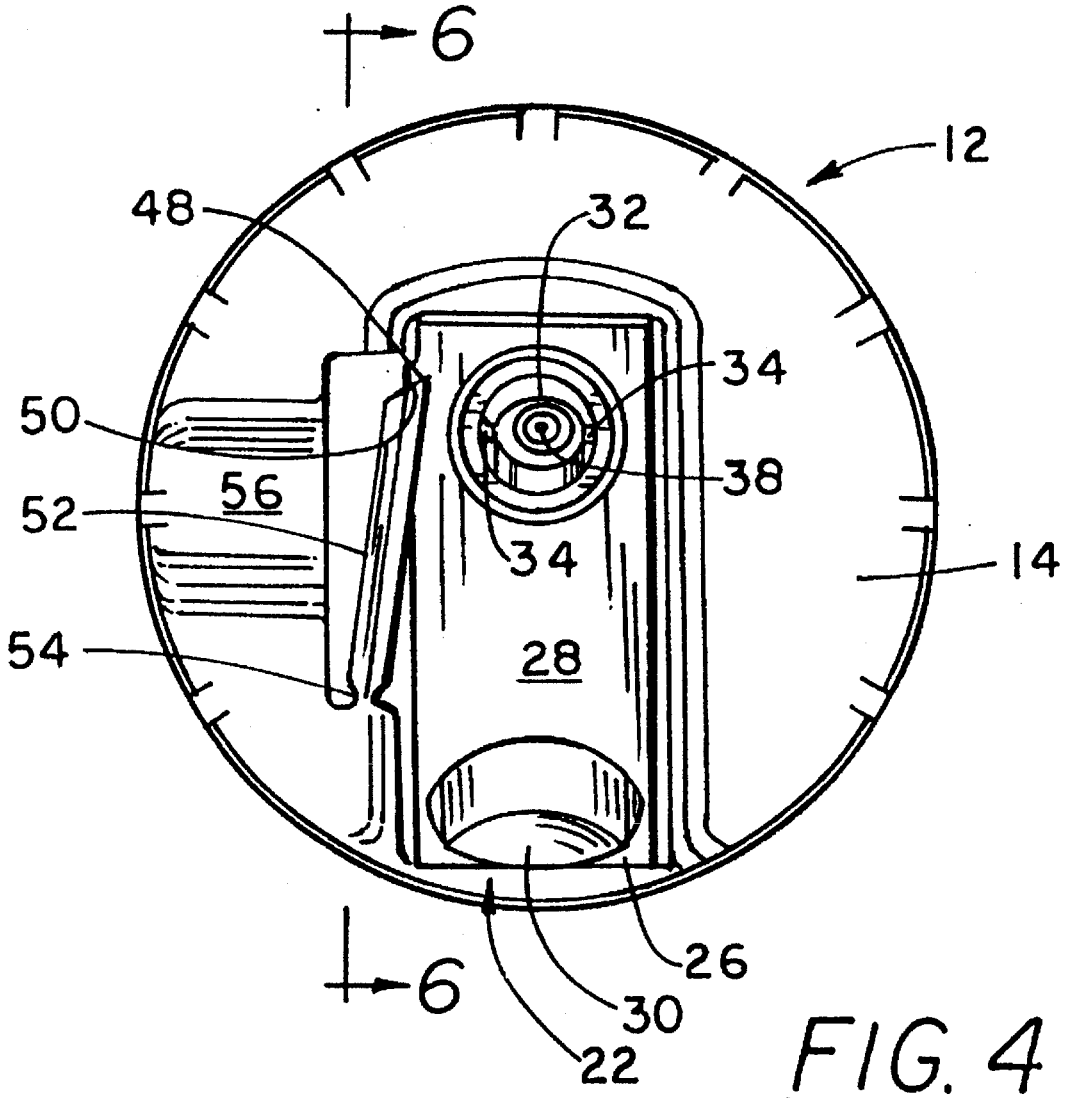
FIG. 4 is a plan view of FIG. 1 showing the holding means engaged to retain the actuator button in its continuous spraying position.
Figure 7:
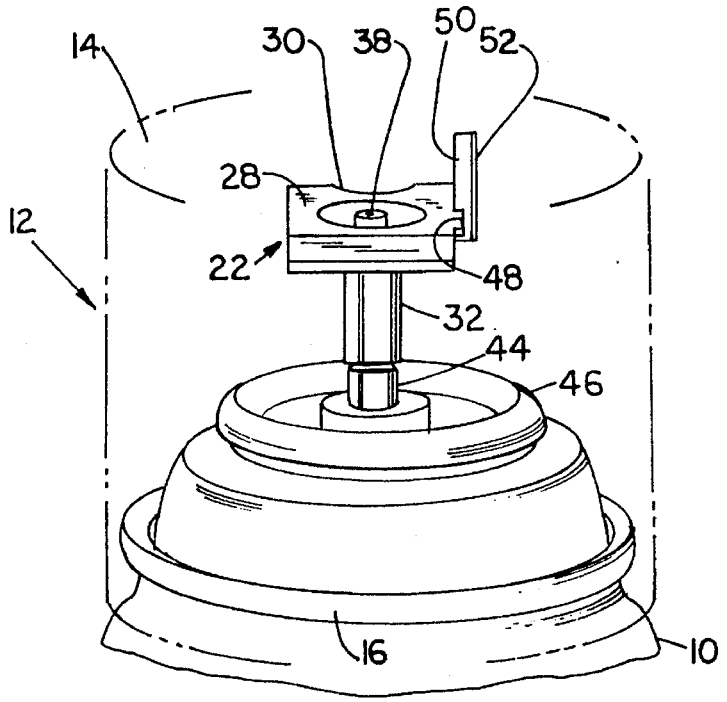
FIG. 7 is a partial cross-sectional view of FIG. 6 taken along section lines 7—7 showing the manner in which the actuator button is retained in its continuous spraying position.

Continuous spray of the contents of container 10 is achieved by having the user press on finger pad 30 to move a first engagement means in the form of catch 48 past the end 50 of a second engagement means in the form of arm 52 which is connected to shell 14 by way of living hinge 54. Arm 52 is pivoted about hinge 54 by finger pressure against the side of arm 52 in the direction of actuator button 22 after the user depresses finger pad 30 to an extent that catch 48 extends past end 50 of arm 52. Indentation 56 in the top of shell 14 leaves room for the user's finger to press against the side of arm 52. The aerosol spray begins due to the movement of actuator button 22 against valve stem 44. The user presses arm 52 over to permit releasable locking engagement of catch 48 and then releases pressure on the finger pad. Arm 52 is of such a length that, when it is engaged with catch 48, it retains actuator button 22 and valve stem 44 in an atomizing spray position for continuous spraying of the contents of container 10 as shown in FIGS. 4, 6 and 7.

Living hinge 54 is of such a material that it normally retains arm 52 in a position as shown in FIGS. 2 and 8 wherein the arm is held away from catch 48 to permit intermittent spray without interference by arm 52. Thus, the natural tendency of hinge 54 is to return arm 52 to its normal position of rest when finger pad 30 is again pressed by the user to a degree that permits catch 48 to release end 50 of arm 52 from its locking engagement with catch 48. Pressure on finger pad 30 is continued until arm 52 moves away from catch 48 (as shown in FIGS. 2 and 8). The user then releases pressure on finger pad 30. This permits actuator button 22 and valve stem 44 to return to the non-atomizing position to stop the continuous spray of the contents of container 10. Thus, the user only needs one hand to release actuator button 22 from its continuous atomizing position. Actuator button 22 can then be unrestrictedly, intermittently actuated until it is again placed in the continuous atomizing position.

Aerosol actuator overcap 12 is conveniently made by injection molding overcap 12 as a single piece using conventional molding techniques. There is no need to assemble or add any further parts to overcap 12 prior to its placement on container 10. As can be seen from an examination of the drawings, particularly the perspective view of FIG. 1, the plan view of FIG. 2 and the bottom view of FIG. 8, the structure of the preferred embodiment of overcap 12 is simple and easy to manufacture. Overcap 12 is preferably made from a plastic material such as polypropylene which possesses sufficient resiliency to permit actuator button 22 to pivot about hinge point 24 and for living hinge 54 to return arm 52 to its normal position away from engagement with catch 48. The plastic used is also selected with the contents of container 10 in mind so that contact with such contents does not dissolve or detrimentally affect actuator button 22 when the contents are sprayed. Other plastics with characteristics similar to polypropylene may also be used. Container 10 is of conventional construction and may be of plastic, metal or glass. Aerosol valves are also well known and commercially available from various sources.

In alternative embodiments, one or more arms 52 could be used in conjunction with corresponding catches 48. While the preferred configuration of catch 48 and arm 52 are illustrated in the drawings, those of ordinary skill in the art will appreciate that other alternative means for holding actuator button 22 in its continuous atomization position could be used which are releasable using only one hand of the user upon subsequent pressure on the finger pad 30. For example, catch 48 could be mounted on the shell and arm 52 could be mounted on actuator button 22 where catch 48 is mounted closer to the finger pad and living hinge 54 is mounted on the side of the actuator button 22 that is opposite finger pad 30 so that release of pressure on finger pad 30 causes end 50 to be held by catch 48. Catch 48 could also be in the form of a hook, notch, indentation or projection and arm 50 could be of a shape that would cooperate with and lock with the type of catch selected. Thus, arm 50 could also be in the shape of a rod and catch 48 could be an indentation shaped to receive the end of the rod to hold actuator button 22 in its atomizing position.

INDUSTRIAL APPLICABILITY

The dual function aerosol actuator overcap of the present invention is particularly useful in conjunction with the delivery of aerosols such as for the delivery of insecticides in the form of finely divided sprays or fogs as well as for delivering air fresheners, germicides, deodorizers, carpet and other fabric treatment agents, polishes, coatings and the like.

Other modifications and variations of the overcap of the present invention will become apparent to those of ordinary skill in the art from the examination of the above specification and drawings. Thus, other variations of the dual function aerosol actuator overcap of the present invention may be made which fall within the scope of the appended claims, even though such variations were not specifically discussed above.

That which we claim is:

1. An aerosol actuator overcap for a self-pressurized container filled with an atomizable liquid and fitted at one end with an aerosol valve having a valve stem with a free end extending away from the valve and a hollow bore placing the free end in pressurized flow communication with the liquid when the valve stem is moved from its normally closed position to an open position, the overcap comprising a shell adapted to be fixed to an outside surface of the container in such a manner that a cavity of an aerosol actuator button, the aerosol button being movably fixed to the shell and containing a top and bottom portion where the cavity is located in the bottom portion thereof and is in flow communication with an orifice in the top portion of the actuator button facing away from the container, is adapted to sealingly receive the free end of the valve stem such that the hollow bore is placed in flow communication with the orifice to permit atomization of the liquid outside of the container when the actuator button and the stem are moved from a normal non-atomizing position with the valve stem in its closed position to an atomizing position with the valve stem in its open position, a first engagement means formed on a surface of the actuator button, and a second engagement means that is flexibly affixed to the overcap in a normally non-engaging position and is movable by a user to an engaging position for locking engagement with the first engagement means, wherein the aerosol actuator button may be unrestrictedly moved by the user to and from the atomizing position while the second engagement means is in its non-engaging position, and wherein the second engagement means is manually engageable with the first engagement means by the user while the aerosol actuator button is held in the atomizing position to retain the actuator button in its atomizing position and thereby provide a continuous flow of atomized liquid from the container, and wherein the continuous flow of atomized liquid may be stopped when the user moves the actuator button in the direction of the atomizing position a sufficient amount to permit the second engagement means to return to its non-engaged position without any contact of the second engagement means by the user, thereby permitting the actuator button to return to its normal non-atomizing position.

2. The overcap of claim 1 wherein the actuator button comprises a hollow body flexibly attached to the actuator button by way of at least one flexible link and wherein the hollow body contains the cavity which is sealingly received by the valve stem.

3. The overcap of claim 1 wherein the first engagement means is in the form of a catch and the second engagement means is in the form of an arm having a living hinge connected to the overcap wherein the living hinge retains the arm in the non-engaging position and an end opposite the living hinge wherein the end of the arm releasably locks together with the catch to retain the actuator button in the atomizing position.

4. The overcap of claim 3 wherein the catch is formed on a surface of the actuator button and the arm of the living hinge is flexibly affixed to the shell.

5. The overcap of claim 4 wherein the actuator button comprises a hollow body flexibly attached to the actuator button by way of at least one flexible link and wherein the hollow body contains the cavity which is sealingly received by the valve stem.

6. An aerosol actuator overcap for a self-pressurized container having a central long axis and being filled with an atomizable liquid and fitted at one end with an aerosol valve having a valve stem with a free end extending away from the valve and a hollow bore placing the free end in pressurized flow communication with the liquid when the valve stem is moved from its normally closed position to an open position, the overcap comprising a shell adapted to be fixed to an outside surface of the container in such a manner that a cavity of an aerosol actuator button, the aerosol button being movably fixed to the shell at a hinge point and comprising a vertical portion extending parallel to the central long axis of the container on which it is to be affixed from the hinge point to a horizontal portion which is perpendicular to the vertical portion and extends over the valve and the horizontal portion has a top and bottom portion where the cavity is located in the bottom portion thereof and is in flow communication with an orifice in the top portion facing away from the container, is adapted to sealingly receive the free end of the valve stem such that the hollow bore is placed in flow communication with the orifice to permit atomization of the liquid outside of the container when the actuator button and the stem are moved from a normal non-atomizing position with the valve stem in its closed position to an atomizing position with the valve stem in its open position, a catch formed on a surface of the actuator button, and an arm that is flexibly affixed to the shell by way of a living hinge in a normally non-engaging position and is movable by a user to an engaging position for releasable locking engagement with the catch, wherein the aerosol actuator button may be unrestrictedly moved by the user to and from the atomizing position while the arm is in its non-engaging position, and wherein the arm is manually engageable with the catch by the user while the aerosol actuator button is held in the atomizing position to retain the actuator button in its atomizing position and thereby provide a continuous flow of atomized liquid from the container, and wherein the continuous flow of atomized liquid may be stopped when the user moves the actuator button a sufficient amount in the direction of the atomizing position to permit the arm to return to its non-engaged position without any contact of the arm by the user, thereby permitting the actuator button to return to its normal non-atomizing position.

7. The overcap of claim 6 wherein the horizontal portion comprises a hollow body flexibly attached to the horizontal portion by way of at least one flexible link and wherein the hollow body contains the cavity which is sealingly received by the valve stem.

8. The overcap of claim 6 wherein the first engagement means is in the form of a catch and the second engagement means is in the form of an arm having a living hinge connected to the overcap wherein the living hinge retains the arm in the non-engaging position and an end opposite the living hinge wherein the end of the arm releasably locks together with the catch to retain the actuator button in the atomizing position.

9. The overcap of claim 8 wherein the catch is formed on a surface of the actuator button and the arm of the living hinge is flexibly affixed to the shell.

10. The overcap of claim 9 wherein the actuator button comprises a hollow body flexibly attached to the actuator button by way of at least one flexible link and wherein the hollow body contains the cavity which is sealingly received by the valve stem.

11. A self-pressurized aerosol container filled with an atomizable liquid and fitted at one end with an aerosol valve having a valve stem on which container the overcap of claim 1 is affixed.

12. A self-pressurized aerosol container filled with an atomizable liquid and fitted at one end with an aerosol valve having a valve stem on which container the overcap of claim 2 is affixed.

13. A self-pressurized aerosol container filled with an atomizable liquid and fitted at one end with an aerosol valve having a valve stem on which container the overcap of claim 3 is affixed.

14. A self-pressurized aerosol container filled with an atomizable liquid and fitted at one end with an aerosol valve having a valve stem on which container the overcap of claim 4 is affixed.

15. A self-pressurized aerosol container filled with an atomizable liquid and fitted at one end with an aerosol valve having a valve stem on which container the overcap of claim 5 is affixed.

16. A self-pressurized aerosol container filled with an atomizable liquid and fitted at one end with an aerosol valve having a valve stem on which container the overcap of claim 6 is affixed.

17. A self-pressurized aerosol container filled with an atomizable liquid and fitted at one end with an aerosol valve having a valve stem on which container the overcap of claim 7 is affixed.

18. A self-pressurized aerosol container filled with an atomizable liquid and fitted at one end with an aerosol valve having a valve stem on which container the overcap of claim 8 is affixed.

19. A self-pressurized aerosol container filled with an atomizable liquid and fitted at one end with an aerosol valve having a valve stem on which container the overcap of claim 9 is affixed.

20. A self-pressurized aerosol container filled with an atomizable liquid and fitted at one end with an aerosol valve having a valve stem on which container the overcap of claim 10 is affixed.

* * * * *